US008511963B1

(12) United States Patent
Bunch et al.

(10) Patent No.: US 8,511,963 B1
(45) Date of Patent: Aug. 20, 2013

(54) PIPE HANDLING ASSEMBLY

(76) Inventors: Billy Bunch, Lindsay, OK (US); Justin Bunch, Lindsay, OK (US)

( * ) Notice: Subject to any disclaimer, the term of this patent is extended or adjusted under 35 U.S.C. 154(b) by 358 days.

(21) Appl. No.: 12/703,618

(22) Filed: Feb. 10, 2010

Related U.S. Application Data

(60) Provisional application No. 61/152,106, filed on Feb. 12, 2009.

(51) Int. Cl.
*E21B 19/00* (2006.01)
*E21B 19/14* (2006.01)

(52) U.S. Cl.
USPC ..... 414/22.57

(58) Field of Classification Search
USPC ..... 14/69.5; 193/30; 198/463.5, 468.6; 414/22.51, 22.52, 22.54, 22.55, 22.56, 22.57, 414/22.58, 22.59, 22.61, 22.62, 538, 745.4, 414/745.5, 745.9
See application file for complete search history.

(56) References Cited

U.S. PATENT DOCUMENTS 2,589,181 A * 3/1952 Yount ..... 414/22.61
3,169,645 A * 2/1965 Freeman, Sr. ..... 414/22.59
3,780,883 A * 12/1973 Brown ..... 414/22.62
3,810,553 A * 5/1974 Crocker et al. ..... 414/22.61
RE28,071 E * 7/1974 Smart ..... 414/746.8
3,916,500 A * 11/1975 Brown ..... 29/240
4,067,453 A * 1/1978 Moller ..... 414/22.61
4,235,566 A 11/1980 Beeman et al.
4,347,028 A 8/1982 Dugan
4,386,883 A * 6/1983 Hogan et al. ..... 414/22.61
4,426,182 A * 1/1984 Frias et al. ..... 414/22.61
4,453,872 A * 6/1984 Frias et al. ..... 414/22.61
4,494,899 A * 1/1985 Hoang et al. ..... 414/22.61
6,079,925 A 6/2000 Morgan et al.
6,533,519 B1 * 3/2003 Tolmon et al. ..... 414/22.54
6,719,515 B2 * 4/2004 Tolmon et al. ..... 414/22.54
6,969,223 B2 11/2005 Tolmon et al.
2005/0238463 A1 * 10/2005 Smith ..... 414/22.52
2006/0075586 A1 * 4/2006 Senior ..... 14/69.5
2006/0285941 A1 * 12/2006 Fikowski et al. ..... 414/22.54
2007/0221385 A1 * 9/2007 Braun et al. ..... 166/379

* cited by examiner

*Primary Examiner* — Gregory Adams
(74) *Attorney, Agent, or Firm* — Daniel P. Dooley; Hall Estill Attorneys at Law

(57) ABSTRACT

A method and apparatus for a pipe handling assembly is disclosed. A pipe handling assembly is provided that has a pusher member, trough, and elevation feature. A pipe component is transported from a first position of the trough to a second position with the pusher member. The pipe component is elevated to a predetermined height through engagement with the elevation feature that is stationary during the pipe component's movement.

4 Claims, 6 Drawing Sheets

FIG. 1
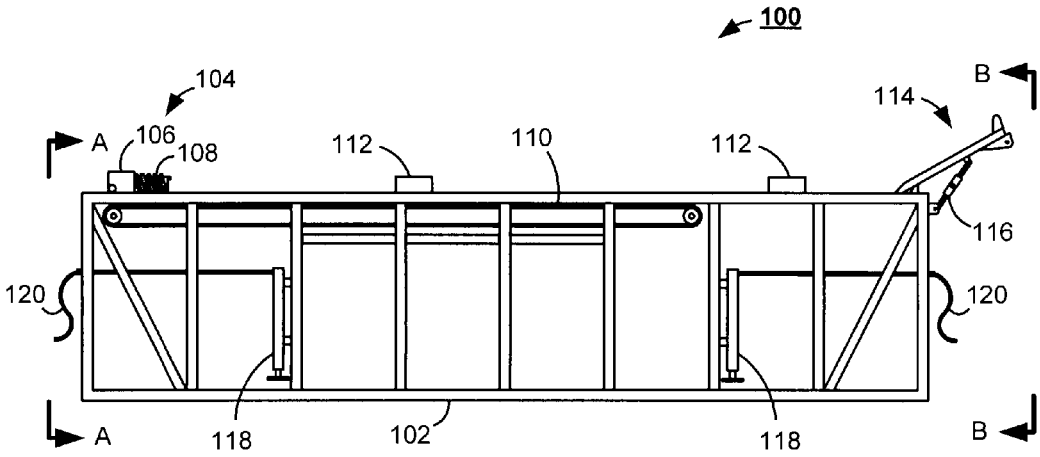
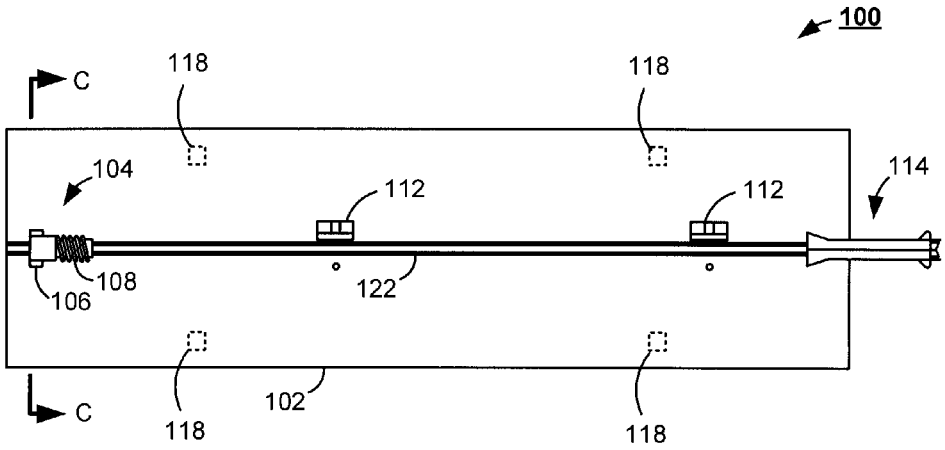
FIG. 2

PIPE HANDLING ASSEMBLY

RELATED APPLICATIONS

This application claims priority to U.S. Provisional Application No. 61/152,106 filed Feb. 12, 2009, entitled "Pipe Handling Assembly."

FIELD OF THE INVENTION

The claimed invention relates to the field of pipe management and more particularly to pipe handling and transportation.

BACKGROUND

The ability to effectively secure and transport piping of various size such as oil derrick piping has been a continued goal of the energy industry for many years.

Historically, heavy and cumbersome oil well piping was manually transported and manipulated during the drilling of an oil well. Several workers would have to work in combination to lift, move, and position extremely dangerous oil well pipe numerous times a day. The combination of heavy loads and awkward shapes created potentially deadly hazards for everyone on a well site.

Mechanisms have been introduced to relieve workers from handling oil well piping unnecessarily. However, the mechanisms have created as many dangerous hazards as they have prevented due to the excessive force of hydraulic pistons and numerous moving parts. An oil well worker could easily get a body part severed or suffer a deadly trauma from the sudden and powerful movement of the various components of past pipe management mechanisms.

As such, the ever growing demand for increased energy production from drilling operations calls for a pipe handling assembly that increases safety while effectively supplying oil well pipe to an oil derrick. Accordingly, there is a continuing need for improved pipe handling assemblies that can secure and transport pipe in a safe and efficient manner.

SUMMARY OF THE INVENTION

In accordance with preferred embodiments, a pipe handling assembly is provided that has a pusher member, trough, and elevation feature. A pipe component is transported from a first position of the trough to a second position with the pusher member. The pipe component is elevated to a predetermined height through engagement with the elevation feature that is stationary during the pipe component's movement.

These and various other features and advantages that characterize the claimed invention will be apparent upon reading the following detailed description and upon review of the associated drawings.

BRIEF DESCRIPTION OF THE DRAWINGS

FIG. 1 shows a side view of an exemplary pipe handling assembly constructed and operated in accordance with various embodiments of the present invention.

FIG. 2 illustrates a top view of an exemplary operation of the convertible mobile receptacle of FIG. 1.

DETAILED DESCRIPTION OF THE PREFERRED EMBODIMENT OF THE DRAWINGS

Figure 3:
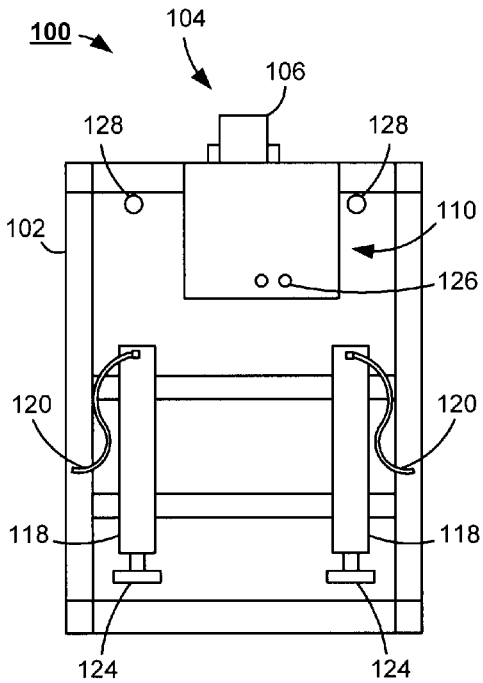
FIG. 3 provides a view of the pipe handling assembly of FIG. 1 from cross-section AA.

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

Referring to the drawings, FIG. 1 shows an exemplary pipe handling assembly 100 constructed and operated in accordance with various embodiments of the present invention. The assembly 100 features a frame 102 that is capable of supporting various components as well as numerous pipe members. It should be noted that the size and configuration of the frame is not limited and can be any configuration that provides the necessary support for the other components of the pipe handling assembly 100. In some embodiments, pipe components are secured and transported via a pusher member 104. The pusher member 104 preferably comprises a rigid portion 106 and a flexible portion 108 that allows secured control of a pipe component during handling. While the flexible portion 108 of the pusher member 104 is shown having a spring, the use of an energy absorbing element is not limited.

Further, the position of the pusher member 104 in relation to the frame 102 is controlled by a drive mechanism 110. In various embodiments, the drive mechanism 110 is capable of positioning the pusher member 104 along the full length of the pipe handling assembly 100. Similarly, the drive mechanism 110 is preferably configured to transport the pusher member 104 and a pipe component along the length of the assembly 100 simultaneously. A preferred embodiment of the present invention has the drive mechanism 110 comprising a hydraulic motor, chain, and sprocket oriented to propel the pusher member 104 along the length of the frame 102. However, the components and configuration of the drive mechanism 110 is not limited and can be any number of appropriate drive elements including, but not limited to, belts, internal combustion engines, electric motors, pulleys, and compressed air.

In addition, a plurality of alignment features 112 are positioned along the length of the frame 102. It can be appreciated that the number and position of the alignment features 112 in FIG. 1 is not limiting as any number of features can be placed throughout the frame 102 to aid in pipe component handling.

Meanwhile at one end of the frame 102, an elevation feature 114 is attached to the frame 102 with at least an adjustment member 116. It should be noted that the orientation and size of the elevation feature is not limited and can be any configuration.

Also in FIG. 1, the frame 102 has multiple stand members 118 capable of supporting the pipe handling assembly 100. In a preferred embodiment, control of the stand members 118 is facilitated by a rotatable handle 120. Hence, manipulating the rotatable handle 120 preferably raises or lowers a portion of the stand member 118 to support and level the assembly 100.

FIG. 2 displays a top view of the pipe handling assembly 100 of FIG. 1. The frame 102 is shown covered, but a covering is not required. The position of the pusher member 104 in relation to the frame 102 is shown as in substantially the midline of the major axis along a trough 122. However, the location of the trough 122 and pusher member 104 is not limited to the midline of the frame 102. Likewise, the shape of the trough 122 can be any configuration that effectively guides the pusher member 104 along the length of the frame 102. The alignment features 112 are displayed in an adjacent relationship to the trough 122, but can be placed anywhere on the frame 102.

In some embodiments, the frame 102 includes a number of stand members 118 that equal the number of corners of the frame 102. It should be noted that the relationship of the pusher member 104 with the trough 122 is not limited to a certain orientation. That is, the pusher member 104 can be substantially above, between, or below the trough 122 without detracting from the spirit of the present invention. In addition, the connection of the pusher member 104 to the drive mechanism 110 with respect to the trough 122 can be facilitated in any number of orientations that allow efficient movement of the pusher member 104.

In FIG. 3, a perspective view of the pipe handling assembly 100 of FIG. 1 is provided from cross-section AA. The frame 102 of the assembly 100 supports a plurality of stand members 118 that each has rotatable handles 120 and foot portions 124. The drive mechanism 110 is shown mounted below the pusher member 104 and enclosed by the frame 102. However, this configuration is not limiting as the drive mechanism 110 can be mounted in any relation to the frame 102 including, but not limited to, external generation locations. The drive mechanism 110 preferably includes connection couplings 126 that allow control of the drive mechanism 110 by a user.

It can be appreciated that the type and number of connection couplings 126 is not limited and can be configured to facilitate any number of control technology. For instance, the connection couplings 126 can have an input and output for hydraulic fluid as well as an electrical connection for remote control management of the drive mechanism 110. Additionally, several sweep members 128 are affixed to the frame 102 of the assembly 100 adjacent to the drive mechanism 110. The sweep members 128 provide added structural support as well as the ability to manipulate the alignment features 112 of FIGS. 1-2.

Figure 4:
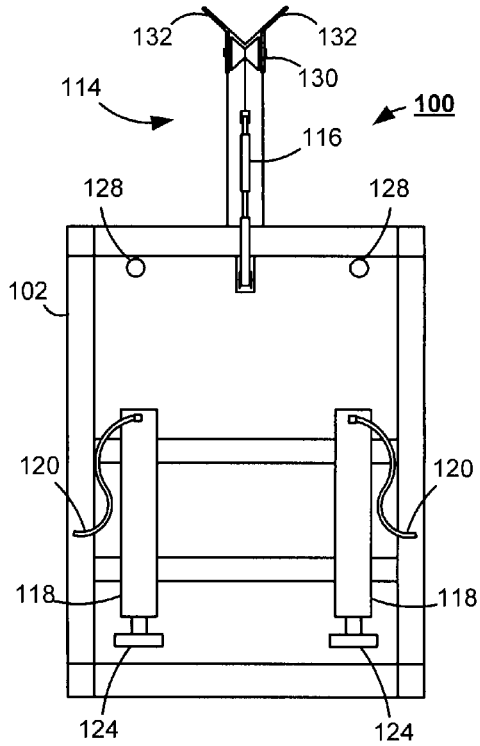
FIG. 4 displays a view of the pipe handling assembly of FIG. 1 from cross-section BB.

FIG. 4 illustrates a perspective view of the pipe handling assembly 100 of FIG. 1 from cross-section line BB. Similarly to FIG. 3, a plurality of stand members 118 each having foot portions 124 and rotatable handles 120 are affixed to the frame 102. In contrast to FIG. 3, the elevation feature 114 is mounted to the frame 102. The elevation feature 114 is connected to the frame 102 by at least the adjustment member 116. In some embodiments, the adjustment member 116 comprises a turnbuckle that maintains the elevation feature 114 in a constant angular relation to the frame 102 and trough 122 of FIGS. 1-2. However, the use of a turnbuckle is not limiting as the adjustment member can be any number of components that constantly maintains a rigid position of the elevation feature 114 in relation to the frame 102.

Further in various embodiments, the elevation feature 114 comprises a v-shaped channel to which a pipe component can easily traverse while maintaining alignment. The highest plane of the elevation feature 114 can include a roller 130 that provides dynamic support for a pipe component. Similarly, a pipe component is maintained in the channel of the elevation feature 114 by a pair of elevation flanges 132. While the flanges 132 are shown at the highest plane of the elevation feature 114, the configuration is not limiting and any number of flanges can be utilized in any orientation to provide added alignment and support for pipe components.

Figure 5:
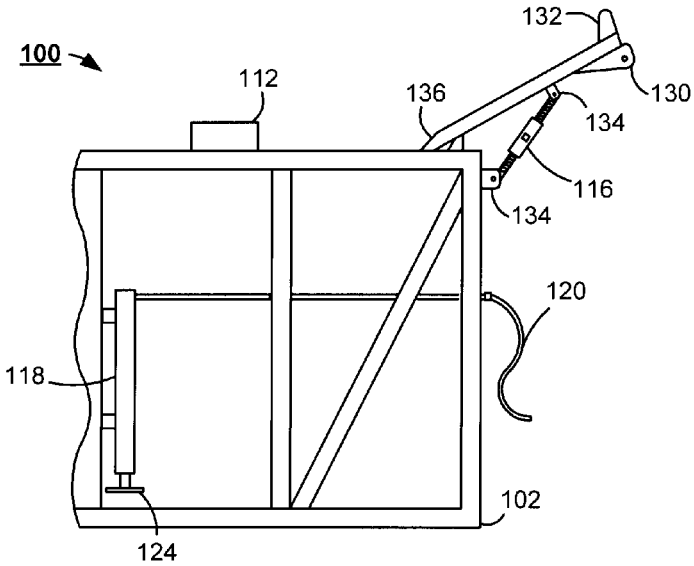
FIG. 5 shows a view of a portion of the pipe handling assembly constructed in accordance with various embodiments of the present invention.

An alternative view of a portion of the pipe handling assembly 100 of FIGS. 1, 3, and 4 is shown in FIG. 5. The elevation feature 114 is shown connected to the frame 102 in a preferred embodiment that has the adjustment member 116 affixed to brackets 134 mounted on both the elevation feature 114 and frame 102. The elevation feature 114 also has an angled portion 136 adjacent to the trough 122 and top of the frame 102. The angled portion 136 provides increased alignment for any pipe member by positioning an increased amount of surface area adjacent to the trough 122. Hence, as a pipe component traverses the length of the frame 102, the angled portion 136 directs the pipe component to the desired channel of the elevation feature 114 in proper alignment.

It should be noted that the roller 130 is shown in FIG. 5 positioned below the elevation feature 114. This configuration is not limiting as the roller and elevation flanges 132 can be oriented in any desired locations to efficiently support and align pipe components traversing the elevation feature 114.

Figure 6:
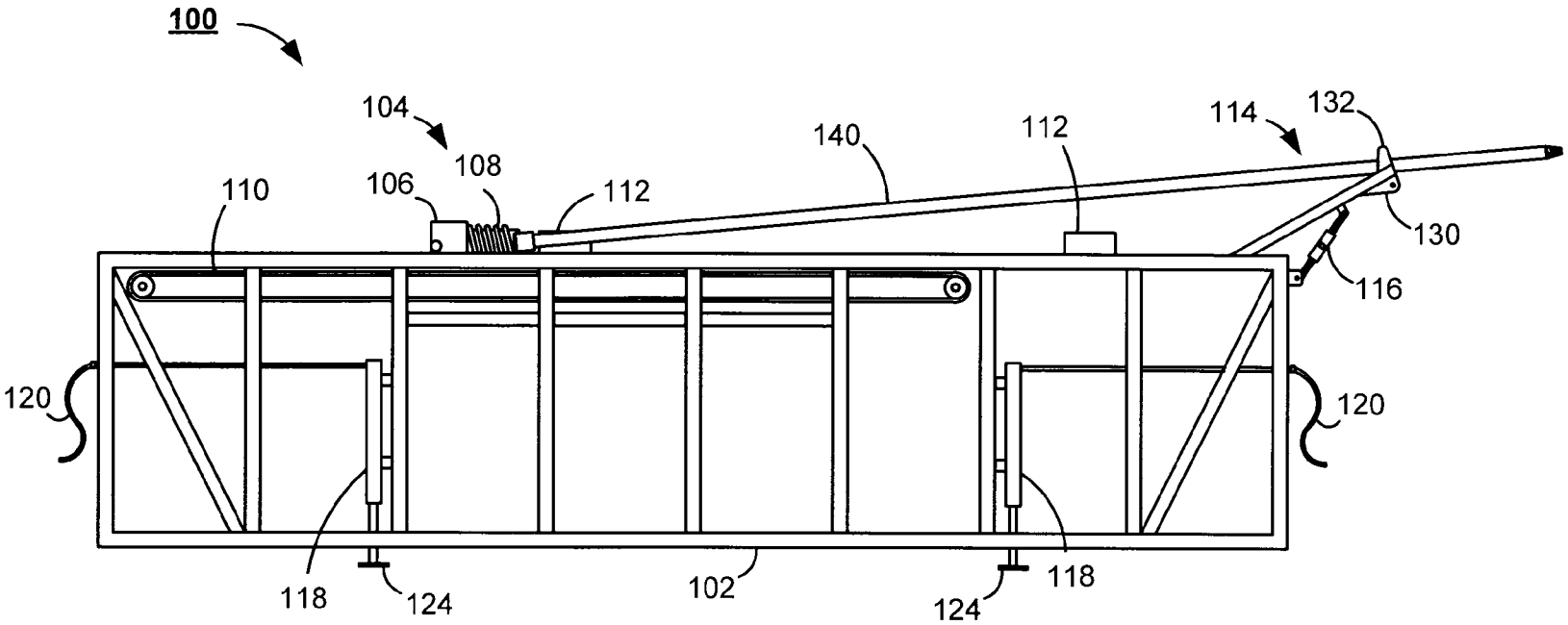
FIG. 6 illustrates an exemplary operation of the pipe handling assembly of FIG. 1.

FIG. 6 shows the pipe handling assembly 100 in operation in accordance with various embodiments of the present invention. The operation of the assembly 100 is preferably carried out with a pipe component 140 positioned in the trough 122 of the frame 102. The drive mechanism 110 is controlled to matriculate the pusher member 104 and pipe component 140 along the length of the frame 102. In the process, the pipe component 140 encounters the angled portion 136 of the elevation feature 114, the v-channel, and the roller 130. Thus, as shown, the pipe component 140 is engaged by the roller 130, elevation feature 114 and pusher member 104. However, various other components can be encountered and engaged by the pipe component 140 such as the alignment members 112 and elevation flanges 132

In an alternative embodiment, a pipe component 140 can be received by the pipe handling assembly 100. The pipe component 140 could encounter the elevation feature 114 and be drawn towards the distal end of the frame 102 by the pusher member 104 being manipulated to move backwards by the drive mechanism 110 while supporting and securing the pipe component 140. As such, the alignment elements such as the alignment features 112 and the elevation flanges 132 direct the pipe component 140 to move along the trough 122 in a desired manner. Additionally, the foot portions 124 of the stand members 118 are extended to provide support for the assembly 100. Preferably, the position of the foot portions 124 is controlled through manipulation of each rotatable handle 120, as needed.

Figure 7:
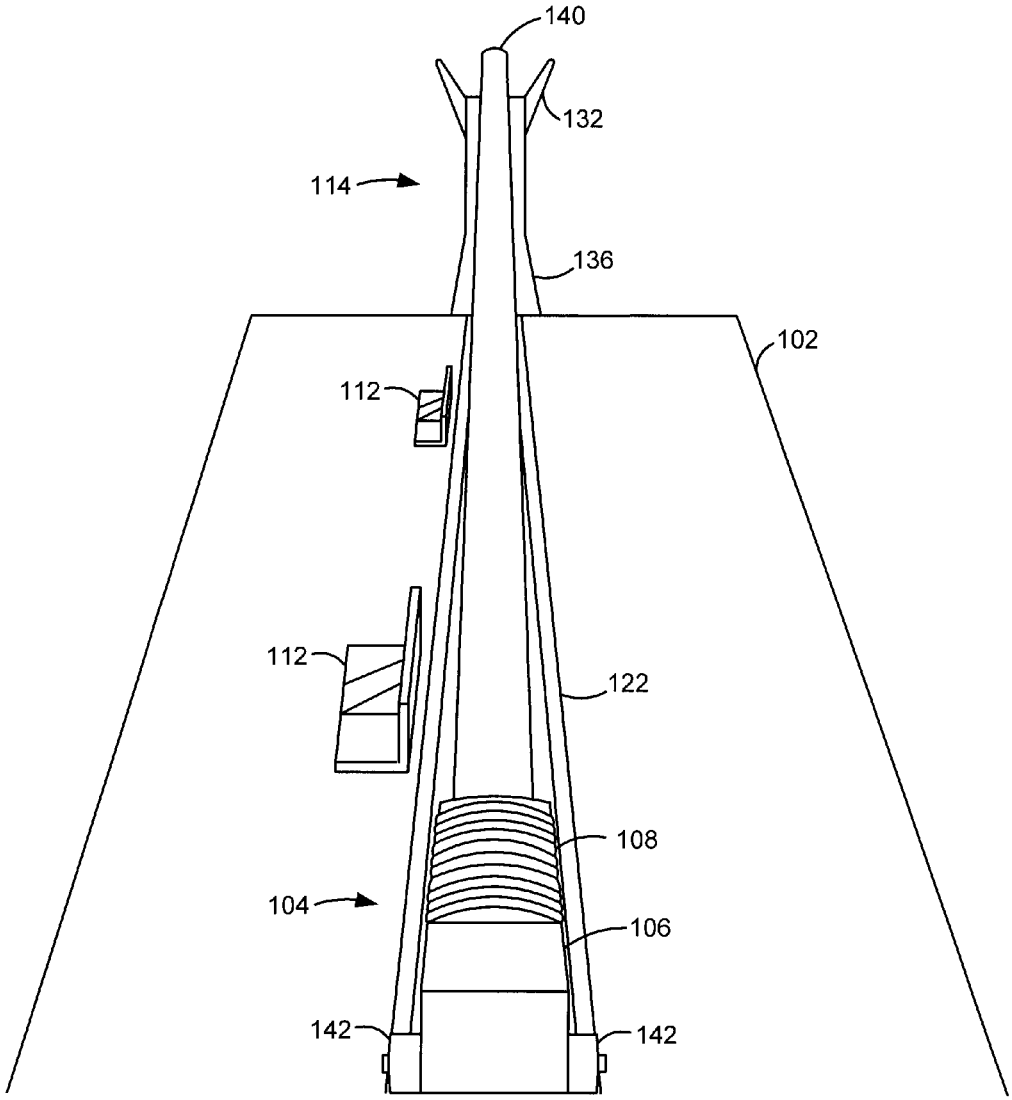
FIG. 7 provides an exemplary operational view of the pipe handling assembly of FIG. 1.

FIG. 7 illustrates a perspective view of the operation of the pipe handling assembly 100 of FIG. 6 in accordance with various embodiments of the present invention. The pusher member 104 has several wheels 142 aligned with the outermost portion of the trough 122. While the number and size of the wheels 142 is not limited, the wheels 142 facilitate a low amount of friction between the trough 122 and the pusher member 104 in some embodiments. The displayed perspective view clearly shows the increased surface area of the angled portion 136 of the elevation feature 114. Similarly, the alignment features 112 are preferably shown in close adjacent relation to the pipe component 140 and trough 122.

In addition, various embodiments of the present invention allow the alignment features 112 to be manipulated to disengage a pipe component 140 from the trough 122. Thus, the alignment features 112 can be configured to engage the trough 122 to manipulate the lateral movement of the pipe component 140. Also, the manipulation of the alignment features 112 can be facilitated manually or remotely through the use of the sweep members 128 of FIGS. 3 and 4. It should also be noted that the flexible portion 108 of the pusher member 104 can adjust to compensate for the increased (or decreased) load of a pipe component 140 as it traverses the trough 122 to provide consistent speed and secure control of the pipe component 140. That is, the flexible portion 108 can adjust to move the pipe component 140 at a constant speed in a controlled manner as the pipe engages the elevation feature 114.

Figure 8:
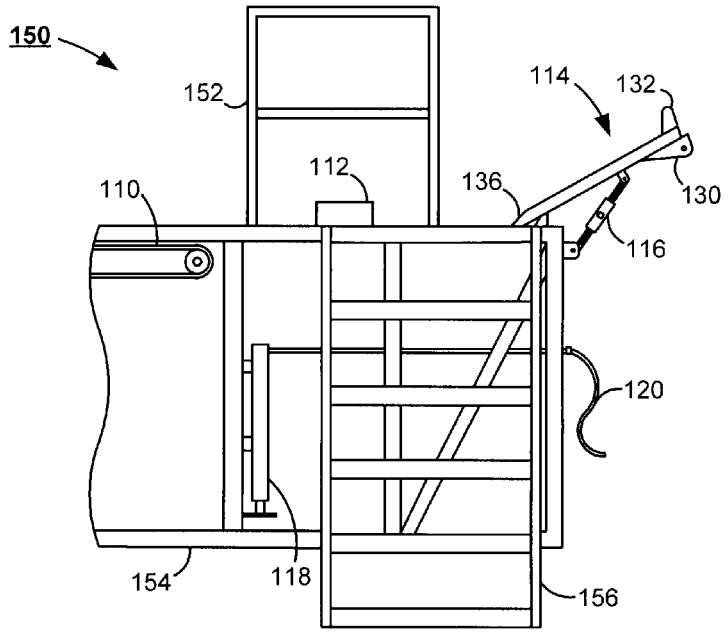
FIG. 8 displays a side view of an alternative exemplary pipe handling apparatus constructed and operated in accordance with various embodiments of the present invention.
Figure 9:
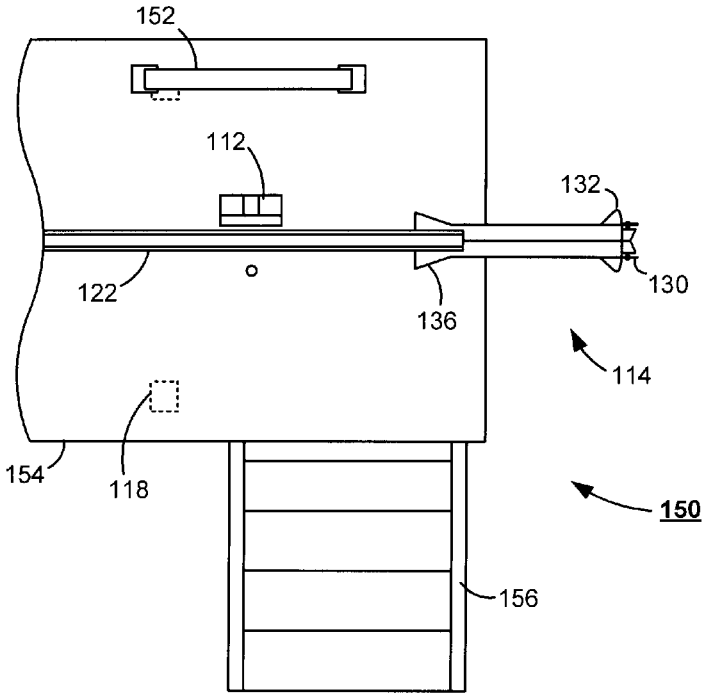
FIG. 9 shows a top view of the alternative exemplary pipe handling assembly of FIG. 8.

An exemplary alternative pipe handling assembly 150 is displayed in FIGS. 8 and 9 as constructed in accordance with various embodiments of the present invention. The alternative pipe handling assembly 150 has a safety rail 152 mounted to a location adjacent an edge of the frame 154. It should be noted that the size and orientation of the safety rail 152 in relation to the assembly 150 is not limited and can be configured to any necessary arrangement. For example, the safety rail 152 could extend along a complete length of the assembly 150 and having a variety of support beams and overall heights.

In addition to the safety rail 152, an access feature 156 is mounted to the frame 154 of the assembly 150 to allow access from a reference plane (i.e. ground) to the top of the frame 154. Much like the safety rail 152, the displayed access feature 156 is not limiting and can be any size or shape necessary to provide efficient access to the top of the frame 154. As such, the access feature 156 could be a ramp that selectively extends from a distal end of the frame 154 to a proximal end of the frame 154 while sloped to vertically connect the top of the frame 154 with the reference plane.

It can be appreciated that the alternative pipe handling assembly 150 can function in a substantially similar manner to the pipe handling assembly 100 of FIGS. 1-7. That is, the pusher member 104 forces a pipe component 140 along a trough 122 to the elevation feature 114 that vertically relocates the pipe component 140 upward. Therefore, the safety rail 152 and access feature 156 do not materially affect the securing or transporting of pipe components.

Figure 10:
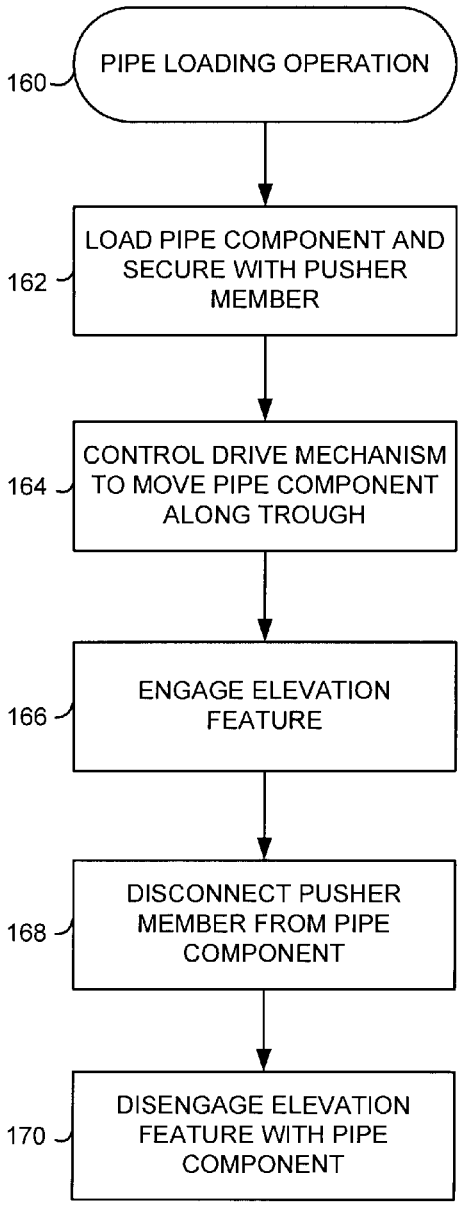
FIG. 10 provides a flow chart representation of a pipe loading operation performed in accordance with various embodiments of the present invention.

FIG. 10 provides a flow chart representation of an exemplary pipe loading operation 160 performed in accordance with various embodiments of the present invention. The operation 160 begins with a pipe component being loaded onto the trough of the pipe handling assembly at step 162 and secured to the pusher member. The pipe component can be loaded either manually or remotely from either an external pipe storage location or the frame of the pipe handling assembly itself. With a pipe component aligned with the trough, step 164 instructs to control the drive mechanism of the pipe handling assembly to matriculate the pipe component along the length of the trough. Step 166 has the pipe component engaging the elevation feature at the distal end of the pipe handling assembly.

It can be appreciated that the pipe component preferably engages the v-shaped channel of the elevation feature to maintain alignment. However, the pipe component can be raised to the top of the elevation feature while keeping with the spirit of the present invention. That is, the elevation feature is stationary at all times during operation of the pipe handling assembly, but the pipe component can be lifted during its travel along the trough so that the top of the elevation feature engages the pipe component, if at all.

In step 168, the pipe component is unsecured from the pusher member as the drive mechanism reverses the position of the pusher member in relation to the elevation feature. Finally, in step 170, the pipe component disengages the elevation feature as it has been vertically lifted from the top of the pipe handling assembly frame to a predetermined elevation.

Figure 11:
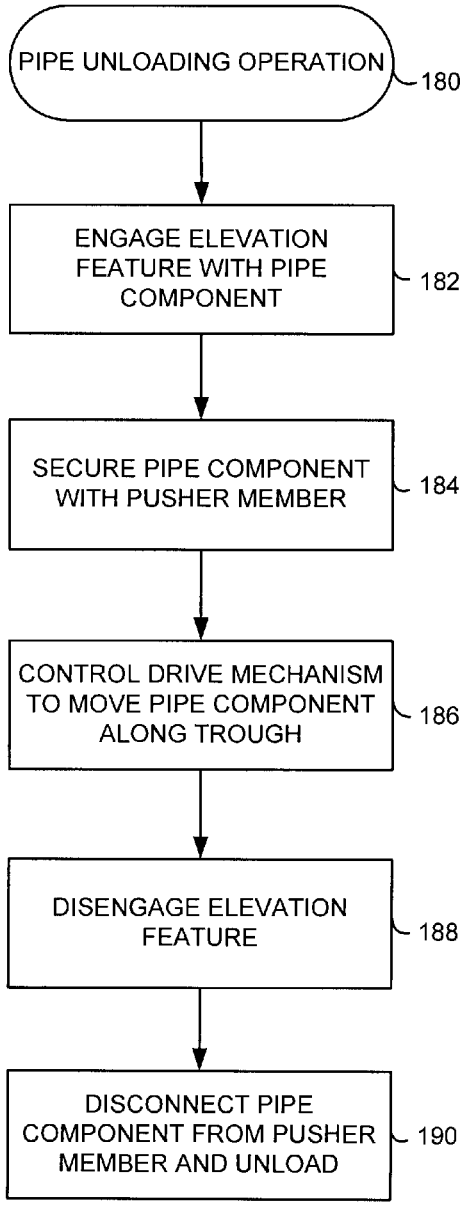
FIG. 11 provides a flow chart representation of a pipe unloading operation performed in accordance with various embodiments of the present invention.

In contrast to the pipe loading operation 160, FIG. 11 provides a flow chart representation of an exemplary pipe unloading operation 180 performed in accordance with various embodiments of the present invention. A pipe component initially engages the elevation member of the pipe handling assembly at step 182 from a predetermined elevation. The pipe component preferably travels down the v-shaped channel of the elevation feature and is received and secured to the pusher member at step 184. Step 186 controls the drive mechanism of the pipe handling assembly to matriculate the pipe component from the elevation feature onto the trough.

In step 188, the pipe component disengages from the elevation feature as the pusher member and drive mechanism reach the opposing side of the pipe handling assembly from the elevation feature. As the pipe component comes to rest in the trough, step 190 instructs to either manually or remotely transfer the pipe component from the trough to a pipe storage region.

It should be noted that the various steps are not limited to singular function. That is, several of the steps of either operation 160 or 180 can be carried out simultaneously. Likewise, the position of the elements of the pipe handling assembly can vary so that the preferred operations 160 and 180 are not applicable without deterring from the spirit of the present invention. Regardless, various steps of the operations of FIGS. 10 and 11 can be omitted, substituted, or repeated as necessary without diverting from the spirit of the present invention.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A pipe handling apparatus comprising:

a frame;

a trough supported by the frame;

a stationary elevation feature supported by the frame in interacting with the trough to align a pipe component into contacting adjacency with the trough, in which the stationary elevation feature remains in a fixed and stationary position relative to the trough through alignment of the pipe, and wherein the trough remains in a fixed and stationary position relative to the stationary elevation feature through alignment of the pipe;

a pusher member supported by the frame and cooperating with the trough;

a drive member supported by the frame and positioned adjacent the trough, wherein the pusher member includes at least a rigid portion linked to the drive mechanism, a compliant portion fastened to the rigid portion, and a wheel secured to the rigid portion and in rolling contacting adjacency with the trough, the compliant portion grasps the pipe component to secure control of the pipe component during transport of the pipe component, and the wheel decreases friction between the rigid portion and the trough during transport of the pipe component;

an adjustment member disposed between the frame and the stationary elevation feature, wherein the adjustment member fixes the stationary elevation member at a predetermined angle relative to the frame, in which the elevation feature comprising:

an elevation flange;

an angled portion adjacent the frame and communicating with the trough; a main body structure disposed between and linking the elevation flange to the angle portion; and a roller secured to the main body portion and interacting with the elevation flange to facilitate transfer of the pipe component.

2. The apparatus of claim 1, further comprising an alignment feature supported by the frame and adjacent trough, wherein the alignment feature establishes a position of the pipe component relative to the trough.

3. The apparatus of claim 1, further comprising a sweep member supported by the frame and attached to the alignment feature, wherein upon activation, the sweep member manipulates an alignment of the alignment feature relative to the trough.

4. The apparatus of claim 3, in which the adjustment member is a turn buckle.

* * * * *